US009937682B2

(12) United States Patent
Schmid et al.

(10) Patent No.: US 9,937,682 B2
(45) Date of Patent: Apr. 10, 2018

(54) DEVICE FOR MANUALLY CREATING SPIRAL-SHAPED PACKAGING MATERIAL

(71) Applicant: Sprick GmbH Bielefelder Papier-und Wellpappenwerke & Co., Bielefeld (DE)

(72) Inventors: Oliver Schmid, Meensen (DE); Bastian Schalk, Lage (DE)

(73) Assignee: Sprick GmbH Bielefelder Papier- und Wellpappenwerke & Co., Bielefeld (DE)

( * ) Notice: Subject to any disclaimer, the term of this patent is extended or adjusted under 35 U.S.C. 154(b) by 73 days.

(21) Appl. No.: 14/428,811

(22) PCT Filed: Sep. 12, 2013

(86) PCT No.: PCT/EP2013/002741

§ 371 (c)(1),
(2) Date: Mar. 17, 2015

(87) PCT Pub. No.: WO2014/044368

PCT Pub. Date: Mar. 27, 2014

(65) Prior Publication Data

US 2015/0273784 A1 Oct. 1, 2015

(30) Foreign Application Priority Data

Sep. 19, 2012 (DE) ..... 20 2012 009 025 U

(51) Int. Cl.
*B31D 5/00* (2017.01)
*B65H 16/00* (2006.01)
*B65H 35/00* (2006.01)

(52) U.S. Cl.
CPC ..... *B31D 5/0039* (2013.01); *B65H 16/005* (2013.01); *B65H 35/008* (2013.01);
(Continued)

(58) Field of Classification Search
CPC ..... B31D 5/0039; B31D 2205/0029; B65H 16/005; B65H 35/008; B65H 2701/1944; A47K 2010/3266
See application file for complete search history.

(56) References Cited

U.S. PATENT DOCUMENTS 3,709,445 A * 1/1973 Adams ..... B65H 16/005 242/422.5
4,171,047 A * 10/1979 Doyle ..... A47K 10/3818 118/506

(Continued)

FOREIGN PATENT DOCUMENTS

DE 102005053319 A1 5/2007
EP 0091411 A1 10/1983
EP 0740921 A1 11/1996

OTHER PUBLICATIONS

Sprick GMBH Bielefelder Papier-Und Wellpappenwerke & Co., International Application No. PCT/EP2013/002741, International Preliminary Report on Patentability, dated Mar. 24, 2015.

(Continued)

*Primary Examiner* — Michael E Gallion
(74) *Attorney, Agent, or Firm* — Dennis J. Williamson; Moore & Van Allen PLLC

(57) ABSTRACT

Device for manually forming spiral-shaped packaging material (3), including a reception (20) for at least partially circumferentially encompassing a wound reel (1) of a web of fiber material defining an axial direction (A) and forming an interior side (2) from which the web of fiber material is drawn for shaping the packaging material (3), and an axial support (30) connected to the reception (20), by which axial support an axial front side (6) of the reel of the web of fiber material facing in drawing direction is held, and having a dispensing opening (11) formed therein for dispensing the packaging material (3) in the axial direction (A), and com- (Continued)

Figure 1:
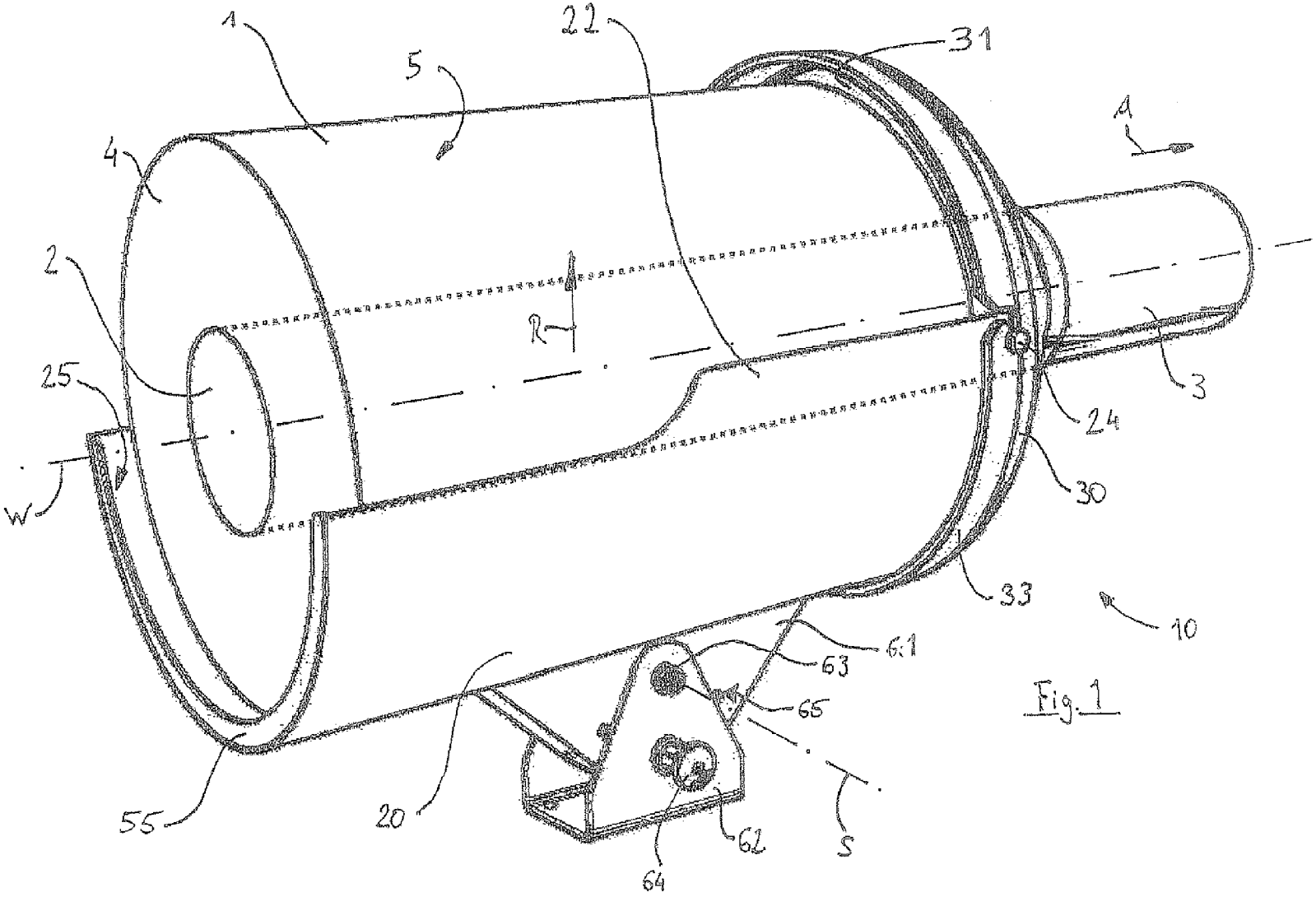

prising an interior wall section (31) facing the front side (6) and tapering towards the dispensing opening (11).

19 Claims, 7 Drawing Sheets

(52) U.S. Cl.
CPC ..... *B31D 2205/007* (2013.01); *B31D 2205/0029* (2013.01); *B31D 2205/0058* (2013.01); *B65H 2701/18422* (2013.01); *B65H 2701/1944* (2013.01)

(56) References Cited

U.S. PATENT DOCUMENTS 5,697,577 A * 12/1997 Ogden ..... A47K 10/38 242/596.8
5,868,346 A * 2/1999 Cobos ..... A47K 10/3818 242/593
6,012,674 A * 1/2000 Leeuwenburgh .. B65H 35/0026 242/588.6
6,089,499 A * 7/2000 Robinson ..... A47K 10/3818 242/560
6,098,836 A * 8/2000 Gottselig ..... A47K 10/32 206/204
6,199,788 B1 * 3/2001 Simhaee ..... A47F 9/042 225/106
6,869,041 B1 * 3/2005 Allegre ..... A47K 10/3818 206/409
7,025,301 B1 * 4/2006 Notarnicola ..... A47K 10/3818 242/593
7,293,738 B2 * 11/2007 Grebonval ..... A47K 10/32 242/597.7
9,192,268 B2 * 11/2015 Denis ..... A47K 10/3818
2006/0261076 A1 * 11/2006 Anderson ..... A47K 10/3818 221/33
2007/0125901 A1 * 6/2007 Serfaty ..... A47K 10/32 242/596.8
2009/0026306 A1 * 1/2009 Kempster ..... A47K 10/3818 242/593
2009/0179103 A1 * 7/2009 Martin ..... B65B 13/18 242/422.6
2012/0165172 A1 * 6/2012 Wetsch ..... B31D 5/0039 493/352
2012/0175455 A1 * 7/2012 Denis ..... A47K 10/3818 242/594
2012/0228167 A1 * 9/2012 Sembritzki ..... A47K 10/38 206/223
2015/0048135 A1 * 2/2015 Bredahl ..... A47K 10/3818 225/42
2015/0216377 A1 * 8/2015 Larsson ..... A47K 10/3818 242/593

OTHER PUBLICATIONS

Sprick GMBH Bielefelder Papier-Und . . . , International Application No. PCT/EP2013/002741, International Search Report and Written Opinion, dated Dec. 9, 2013.

* cited by examiner

DEVICE FOR MANUALLY CREATING SPIRAL-SHAPED PACKAGING MATERIAL

The invention relates to a device for manually creating spiral-shaped packaging material.

There are a number of possibilities for providing spiral-shaped packaging material such as oftentimes formed on the basis of a web of fiber material, in particular a paper web, for manual processing. If the packaging material is wound to a reel, a generic packaging material can be unwound and/or drawn either from the outside or from the inside of the reel. According to the invention, the packaging material is unwound and/or drawn from the inside of the reel.

In AT 402 496 B, which shows an established method for manufacturing filling material for the purpose of packaging, a carrier means in form of a movable sideboard is described. The sideboard laterally has a console arranged close to the ground, onto which a first reel having a vertical winding axis set. The top of the sideboard has two semicircular ribs into which a second reel having a horizontal winding axis is inserted. Packaging material can be unwound by an operator from the insides of both reels, by guiding the packaging material from the first reel through the second one and then drawing material of both reels in shaped like a hose. Adjacent to the second reel on top of the sideboard, a cutting device is provided which is realized by means of hand lever shears for separating a drawn hose of packaging material into individual sections. Therefore, the operator has to first open the shear lever with one hand, then guide the packaging material through the opened shears with the other hand, and afterwards operate the shear lever. This is cumbersome and dangerous because the operator has to grasp through the opened shearing region in order to draw packaging material, wherein each grasp involves the risk of injury, in particular when the operator is careless and lets go of or moves the shear lever. The sideboard requires a large amount of space and can only be arranged adjacent to the work space of the operator with a static dispensing direction. Furthermore, the known sideboard has the disadvantage that, for providing dense packaging material, two paper reels are required, which increases the cost of the device.

The applicant has identified the requirement of providing a device for manually creating spiral-shaped packaging material which device requires only little space at the operator's workspace. Furthermore, it is desired that packaging material shall be provided in the immediate vicinity of the operator's workspace and that the operator may freely choose the direction of the material dispensing and also change it during operation.

It is an objective of the invention to overcome the disadvantages of the prior art, in particular to provide a device for manually creating spiral-shaped packaging material which is as inexpensive as possible, which poses only little danger of injury, which can be arranged in different directions, which is safe to use and as compact as possible, without having a complicated and/or lengthy process of loading the device with a reel of a web of fiber material.

This objective is solved by the features of claim 1.

Accordingly, the device for manually creating a packaging material includes a reception and an axial support connected thereto having a dispensing opening and a tapering interior wall section. The packaging material can for example be paper, recycling paper, natron kraft paper, natron mixed paper, or reeled corrugated cardboard. The reception allows for at least partially circumferentially encompassing a reel of a web of fiber material which defines an axial direction and forms an interior side from which the web of fiber material for forming the packaging material is drawn. The inside or interior side of the reel is formed by the innermost winding of the web of fiber material and comprises the end of the web of fiber material which is being drawn out of the reel for forming the packaging material. The other, opposite end of the web of fiber material is arranged at the outer circumference of thereof. By drawing or unwinding the web of fiber material from the inside of the reel, the operator merely has to apply force for moving the desired amount of packaging material so that is not required to overcome the inertia of the entire reel of web of fiber material, which allows the operator to quickly draw a desired length of packaging material from the reel of the web of fiber material and simultaneously allows for accurately metering, since the inertia of the reel of the web of fiber material does not have to be decelerated towards the end of the drawing process.

An axial support connects to the reception, by which axial support an axial front side of the reel of the web of fiber material facing in the drawing or dispensing direction is held. When the reel of the web of fiber material lies in the reception, it supports itself radially against the reception and axially against the inside of the axial support. A dispensing opening for dispensing the packaging material in the axial direction is formed in the axial support. Preferably, the winding axis of the reel of the web of fiber material extends through the dispensing opening. However, the dispensing opening could also be realized in a slot-shape and may not be arranged aligned with the winding axis of the reel of the web of fiber material. The windings of the reel of the web of fiber material are approximately circular in shape and formed around the winding axis of the reel which defines the alignment of the axial direction. Furthermore, the axial support has an interior wall section facing the axial front side of the reel of the web of fiber material, which interior wall section tapers towards the dispensing opening. By means of the tapering, the reel of the web of fiber material adjacent or fit to the interior wall section is preshaped such that the innermost winding of the reel of the web of fiber material is offset in the axial direction with respect to the second and each further winding, in particular with respect to the outermost winding. Through this, the web of fiber material is guided towards the dispensing opening during drawing, such that the drawn web for forming the packaging material does not only experience a change in direction immediately at the dispensing opening, but the change in direction is being introduced earlier for avoiding an undesirable ripping of the web of fiber material or packaging material.

Preferably, the interior wall section tapers in the axial direction towards the dispensing opening in a funnel shape. The funnel shape in particular tapers constantly, increasingly or decreasingly, i.e., can be cone shaped or truncated cone shaped, trumpet shaped or bulbous. The tapering can for instance also be in the shape of a just or skew pyramid. Furthermore, the axial support can comprise multiple tapering interior wall sections, each having a different shape. In particular, the interior wall section is rotationally symmetrical. Also the entire axial support can be substantially rotationally symmetrical in shape and/or have a substantially constant wall strength.

A rotationally symmetrical, cone shaped funnel shape is particularly easy to manufacture and therefore particularly inexpensive. Furthermore, a funnel shaped interior wall section of an axial support allows for a well-defined guiding of the reel of the web of fiber material or of the drawn packaging material from the reel towards the dispensing opening, such that premature ripping of the web of fiber material due to a sudden strong change in direction of the web at of the dispensing opening is avoided.

In a preferred embodiment, the opening angle of the interior wall section is at most 150°, in particular at most 100°, and at least 30°, in particular at least 70°. A small opening angle of the interior wall section allows for precise guiding of the web towards the dispensing opening and causes the packaging material to be spirally shaped upon drawing, so that the packaging material is already compact and pre-compressed as soon as it is dispensed so that a dense packaging material can be provided in a particularly easy manner. A large opening angle of the interior wall section of for instance about 135° on the other hand causes the packaging material to leave the dispensing opening in an increasingly oblong shape due to the spiral windings moving apart from one another, which is particularly suitable for providing a rather flat packaging material. Furthermore, a large opening angle of the interior wall section has the advantage that when the device for manually creating packaging material is arranged with its dispensing direction facing downwards, the mass of the reel of the web of fiber material is at least partially carried by the interior wall section, so that the large opening angle can avoid that the paper web slides through the dispensing opening merely due to gravity and its mass, without an operator deliberately drawing packaging material.

Preferably, the opening angle of the interior wall section is between 85° and 95°, in particular about 90°. Surprisingly, an opening angle of the interior wall section in the range of between 85° and 95°, in particular 90°, allows for a particularly flexible usability of the device which is at the same time barely prone to errors, since it has been shown that an opening angle of about 90° on the one hand allows for efficiently guiding the packaging material towards the dispensing opening and, on the other hand, an opening angle of 90° is sufficiently large to avoid the reel of the web of the fiber material from unwinding and falling out of the dispensing opening even when the reception is arranged at an angle or even vertically.

Preferably, the reception is attached to the axial support, in particular in a releasable manner. The reception and the axial support can for example be designed integrally which simplifies mounting, or can be releasably attached to one another so that the axial support can be exchanged.

In a preferred embodiment, the axial support comprises at least one attachment collar, in particular a front and/or back attachment collar. Due to the provision of an attachment collar to the axial support, mounting the axial support for example to the reception can be simplified and the provision of the attachment collar to the axial support allows the operator to easily attach miscellaneous members to the axial support without damaging it.

Preferably, the back attachment collar at least partially encompasses the reception. This allows for a particularly easy and quick mountability of the axial support to the reception and enables the user to interchange different axial supports according to demand or to separate an axial support from the reception in order to simplify the loading of the reception with and new reel of web of fiber material. In particular, the reception and the axial support are a rotation body and are coaxially aligned when imposed on one another.

Preferably, an attachment collar connects to the interior wall section in the axial direction so that further members, such as a blade for separating the packaging material, can be arranged in the extension to the interior wall section. Preferably, the attachment collar is substantially cylindrical to prevent the paper web from colliding with an edge of an attachment collar upon unwinding from the reel.

In a further development of the invention, an attachment collar has a slot cooperating with a movable pin, for instance of the reception, forming a bayonet mount and/or a snap connection. A snap connection allows for simple mounting. A bayonet mount is easy to attach and provides for increased retaining forces for instance in the axial direction, which is particularly suitable for devices in which the packaging material is drawn downwards, because, when the axial support is attached to the reception by means of a bayonet mount, it is easily avoided that the axial support carrying the reel falls or slides from the reception. Preferably, the interior wall section can be fastened to the reception using a first attachment collar having a bayonet mount as described above, and opposite to the reception having a blade which is screwed onto a second attachment collar circularly around the dispensing opening of the axial support.

In a preferred embodiment of the device, a blade, preferably in the shape of a in particular fully circumferential ring cutter, is arranged at the interior circumference of the dispensing opening. The interior circumference can for example also have another shape than a circle shape. When a blade is arranged at the interior circumference of the dispensing opening, the device is particularly compact. When the blade does not encompass the entire interior circumference, the risk of injury for the operator is particularly low and it is avoided that the web of fiber material unintentionally comes into engagement with the blade and rips it apart accidentally. A ring cutter allows for a particularly fast creation of packaging material using the device because the operator can move the paper web away from the dispensing opening in any direction in order to separate it from the reel.

In a further development of the invention, the blade has multiple teeth. The teeth can for example be integrally formed with the axial support, for instance in case of the axial support being injection molded plastic part. The teeth preferably extend at least partially radially inwards and/or axially in the direction of dispensing, in particular at an angle of about 45° with respect to the axial direction. With the teeth extending in the radial direction, ripping the packaging material from the reel is possible with minimum effort, whereas an axial extension of the teeth provides results in a particularly low risk of injury for the operator when grasping through the dispensing opening of the device, since no injury due to the teeth can occur even when the operator comes into a tangential contact with them. It has been shown that an angle of about 45° with respect to the axial direction provides for a particularly good compromise between risk of injury and necessary effort.

In a preferred embodiment, the blade has an attachment ring which is in particular realized as a metal ring attachable to the outside of the axial support. An attachment ring allows the operator to quickly and easily replace the worn blade with a new one. Preferably, the attachment ring can be releasably attached to a front attachment collar, preferably with at least one screw, in particularly using 3 or 4. The cooperation of the attachment ring and the front attachment collar of the axial support significantly simplifies mounting the blade to the axial support for the operator, so that a worn blade can be replaced very quickly.

In a preferred embodiment of the invention, the dispensing opening is dimensioned sufficiently large for allowing an operator to grasp through it for gripping packaging material inside the device with multiple fingers. By a sufficiently large dimensioned dispensing opening, the operator is not forced to push in the paper web in a complicated manner from the back through the dispensing opening for creating the packaging material, in case it has ripped or in order to draw it from the device for the first time after loading. For a quick and simple operability of the device, the dispensing opening is sufficiently large for the operator to grasp into it using at least two, preferably three, fingers or even the entire hand, in order to grip the packaging material in a simple manner without any complicated movements. In particular, no members, for example movable or sharp edged members, such as gear wheels, are arranged between the reel of the web of fiber material and the dispensing opening, which could render the grasp of the operator into the device more complicated and possibly even pose a risk of injury Particularly, the interior diameter of the dispensing opening is larger than 2.5 cm, in particular larger than 5 cm, or larger than 10 cm, and/or smaller than 30 cm, preferably smaller than 15 cm, in particular smaller than 11 cm. In order for the operator to be able to grip the packaging material through the dispensing opening, the interior diameter of the opening must be at least about 2.5 cm, and in order to be able to grasp through the opening with the entire hand, it should be larger than 10 cm. The dispensing opening is formed smaller than 30 cm, preferably smaller than 15 cm so that the operator on the one hand can grasp into it with the entire hand but on the other hand the reel shall not unwind through the dispensing opening unintentionally. When the packaging material for example has a particularly low coefficient of friction, the diameter of the dispensing opening may be elected to be smaller than 11 cm.

Preferably, the reception is substantially semi-cylindrically, so that a corresponding semi-cylindrical loading opening for loading the reception of the device with the reel in the radial direction, and in particular in the axial direction, is provided. Surprisingly it has been shown that a semi-cylindrical reception allows for a particularly quick and failure proof loading with reel of a web of fiber material, for example a paper reel, since the operator can securely hold a reel of fiber material at the front head side and the lower edge of the reel during loading, and set it into the device using both hands without damaging the packaging material during loading. The reel of the web of fiber material for creating a packaging material can be a paper- or cardboard-material wound to a reel or alternatively a plastic foil, an air bubble film, a metal foil, an aluminum foil or a composite foil comprising several materials wound to a reel. Unlike when loading in the axial direction, the operator is not forced to carry the reel at the outer circumference, wherein the outer winding of the reel of the web of fiber material oftentimes rips or slips out of place. When the reception is in the shape of a half-shell, it can be loaded particularly quickly. By loading in the radial direction, the reel of the web of fiber material can be set into a correspondingly shaped cylindrical reception in an accurately fitting manner. In particular, the reception is at least partially shaped as a half shell. Half shells are inexpensively and easily manufactured for example from sleeve shaped or flat metal sheets.

Preferably, the interior circumference of the reception corresponds to the exterior circumference of the reel. When the exterior circumference of the reel nestles up against the interior circumference of the reception, a particularly safe support of the reel is realized which allows to move the device, for example vertically, horizontally and/or rotatingly, without any occurrence of relative movement between the reel length the reception.

In a further development of the invention the reception comprises a support section and/or a retaining section. The retaining section extends over at least half of the cylindrical circumference, i.e. 180°, preferably over 190°, and provides for a retaining of the reel of the web of fiber material in the radial direction, and thus avoids for example that the reel of the web of fiber material unintentionally slides or rolls out of the device, for instance when the device is being moved by the operator. Surprisingly it has been shown that only little more than half of the circumference of the reel of the web of fiber material needs to be encompassed by the retaining section, in particular about 190°, in order to ascertain that the reel of the web of fiber material does not inadvertently slide laterally out of the reception. At the same time, the flexibility of the retaining section allows for an easy loading of the device with a reel of web of fiber material.

The support section of the reception extends over at most 180°, in particular over 170°, of the cylinder circumference in order to carry a portion of the load of the reel of the web of fiber material without impeding the loading operation. The support section can be arranged in the direction of the dispensing packaging material in front of or behind the retaining section. It is also possible that the reception includes multiple alternating support- and retaining sections which are arranged in a tooth- or comb-like manner.

In a preferred embodiment, the retaining section is longer in the axial direction than the support section. Surprisingly it has been shown that a particularly advantageous reception is realized by a support section being longer than a retaining section, which support section provides a stable reception for the reel of the web of fiber material, wherein the reception at the same time remains sufficiently elastic for the device to be quickly and easily loaded. In case the reception has multiple support- and retaining sections, the sum of the lengths of the retaining sections in the axial direction can be longer than the sum of the lengths of the support sections in order to result in the same effect.

In a preferred embodiment of the invention, the reception has an end abutment for limiting the freedom of movement of the reel of a web of fiber material in the axial direction, the end abutment being arranged opposite to the axial support and extending radially inward in an assembled condition. Such an end abutment ensures that the reel of the web of fiber material remains within the reception of the device even though the direction of dispensing of the device is arranged upwards at an angle. Surprisingly it has been discovered that unwinding or drawing from the reel of the web of fiber material steeply upwards at an angle or vertically allows for a particularly quick drawing action, while the device for manually creating packaging material can be arranged below the work surface of the operator in a space-saving manner. Furthermore, the end abutment can avoid that the reel of the web of fiber material accidentally slides axially out of the reception during movement of the device, so that an end abutment renders the device more failure proof.

Preferably, the end abutment is formed as a fully circular ledge or plate. A reel has a circular base-cross-section which can be set onto a fully circular ledge in a space-saving manner and be optimally supported in the axial direction. In this manner, the ledge allows the device to be arranged with the dispensing direction facing vertically upwards. Preferably, the end abutment, which can be a substantially fully circular ledge, can have at least one convex gripping or handling aperture along its outer edge for simplifying the loading action.

Preferably, the end abutment is not realized by means of block material but instead using openings or apertures, such that the cost of material is decreased and so that the operator is enabled to quickly check how much packaging material remains in the reception by a short view through the apertures. The end abutment is preferably formed lattice-like, wherein the apertures may be arranged regularly and shaped like squares, rectangles, triangles, circles or trapezoids. A lattice-like formed end abutment is advantageously stable, light, and impedes the view that the content of the device only insignificantly.

In a preferred embodiment, the reception comprises a flange which extends in particular radially away from the reception and through which at least parts of a pivot pin extend perpendicular with respect to the axial direction, the pivot pin defining a pivot axis around which the reception is pivotable. The reception side flange is attachable to the reception and can in particular be formed integrally with the reception. By means of a pivoting device, the operator is enabled to arrange the reception for operation of the device in any chosen angle. A pivot pin extending through two flange connections can realize a pivoting device in a particularly easy and inexpensive way.

In particular, the distance of the winding axis to the axis of rotation of the pivot pin substantially corresponds to the distance of the winding axis to the pivot axis so that the pivot axis does not intersect the winding axis and is arranged crooked with respect to the winding axis.

Preferably, the pivot pin extends at least partially through the mounting flange and in particular a locating pin extends, particularly in parallel or coaxially with respect to the pivot axis, at least partially through the reception side flange and/or the mounting flange for defining a pivot position. Preferably, the locating pin comprises a threat. The locating pin can for example be screwed through a threaded hole of the reception side flange and be screwed against the mounting flange in order to define the arrangement of the device and thus its dispensing direction.

Preferably, the carrier structure side flange and/or the mounting flange include multiple, in particular 3, 5 or 7, locating apertures which preferably correspond to the locating pin for defining a pivot position. In case multiple locating apertures are provided, the operator can choose between the pivot positions defined by the locating apertures to select the one he finds most suitable. In particular, the locating apertures correspond to the locating pin. When a locating pin is inserted through a flange into a locating aperture of the other flange, a positive connection between pin and aperture is realized and thus a particularly safe definition of a pivot position is achieved.

Preferably, the flange is arranged opposite to the loading aperture at the reception. This results in a particularly advantageous flux of forces for receiving the mass-force of the reel of the web of fiber material through the pivot device into the carrier structure, without any torsional forces acting onto the pivoting device so that the pivoting device can be realized inexpensively.

A further development of the invention relates to a device for manually creating a packaging material comprising a carrier structure. The carrier structure can be formed as a table, in particular as a table leg or a table top, and/or as a rack. A rack can in particular be movable and preferably has at least one cantilever arm. When the device is connected to a table such as usually provided to the operator as a work space, additional cost incurring carrier structure elements can be dispensed with. A rack enables a flexible arrangement of the device carrying a paper reel above or adjacent to the workspace of the operator. A movable cantilever arm can for example be utilized in order to move the device between the workspaces of two or more operators.

Preferably, the carrier structure comprises a rotation device for allowing a rotational movement of the device with respect to an axis of rotation not corresponding to the axial direction. This results in the advantage of the device of being easily and quickly able to be rotated to and fro multiple workspaces.

Preferably, the axis of rotation is arranged perpendicularly with respect to the pivot axis of the pivot device and in particular intersects the reception. When the axis of rotation intersects the reception and the reel of web of paper material contained therein, the operator can rotate the device particularly smoothly around the axis of rotation.

Preferably, the rotating device comprises a rotation pin, a sleeve-shaped pin reception corresponding to the rotation pin in which the rotation pin is received, and a fixation pin for defining a rotational position which extends at least partially through the pin reception and/or which comprises a thread. Such a device is particularly advantageous because it is easy and inexpensive to manufacture and allows for safely rotationally positioning the device with respect to the carrier structure. The fixation pin can create a force fitting and/or positive connection, wherein in particular a positive connection, for example with respect to a quick release clamp, offers the advantage of realizing a particularly safe connection in a simple and inexpensive manner.

Preferably, the carrier structure comprises a mounting plate for mounting the carrier structure onto a plane, such as a table, a wall or the floor.

Further preferred embodiments of the invention can be derived from the sub claims.

Figure 2:
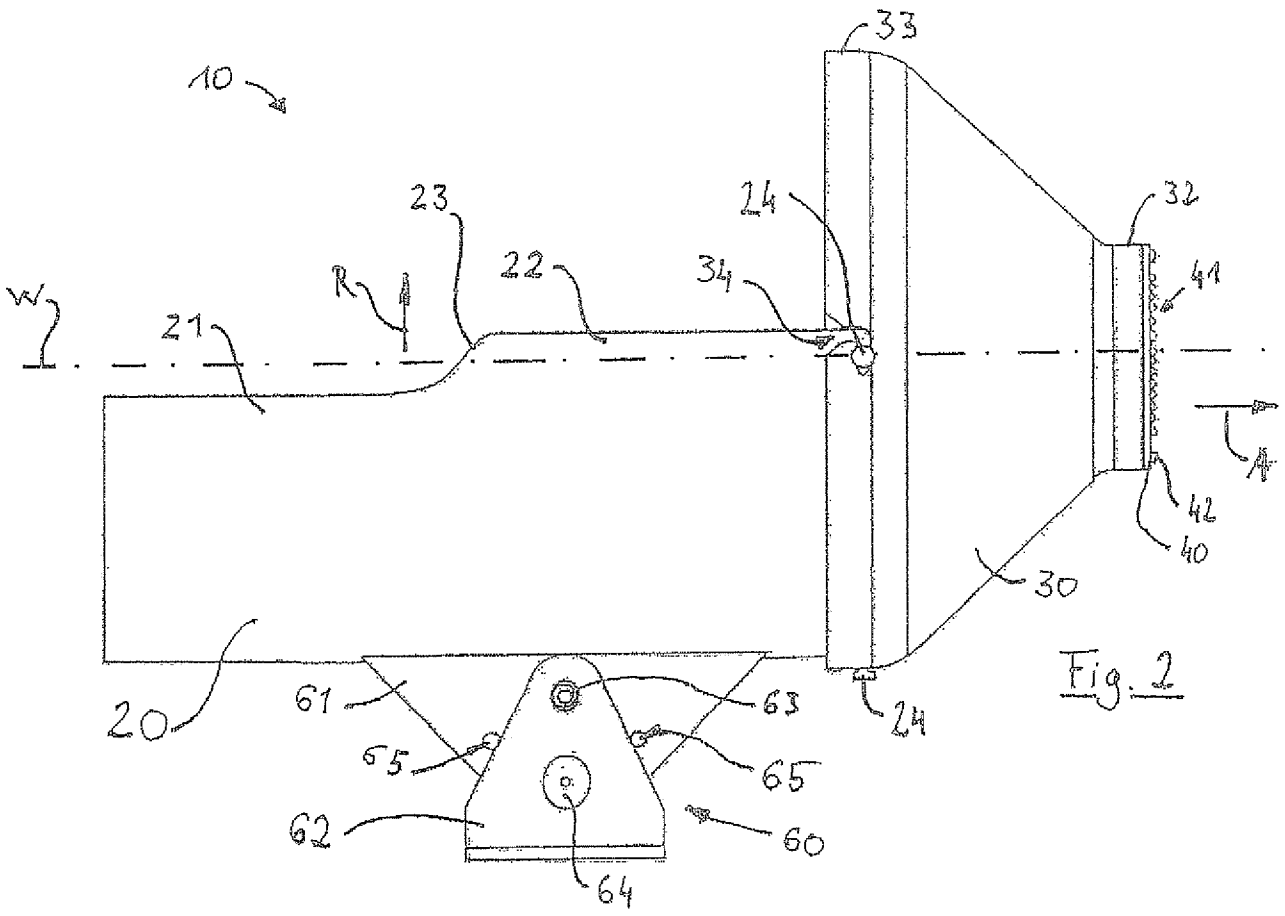
Figure 3:
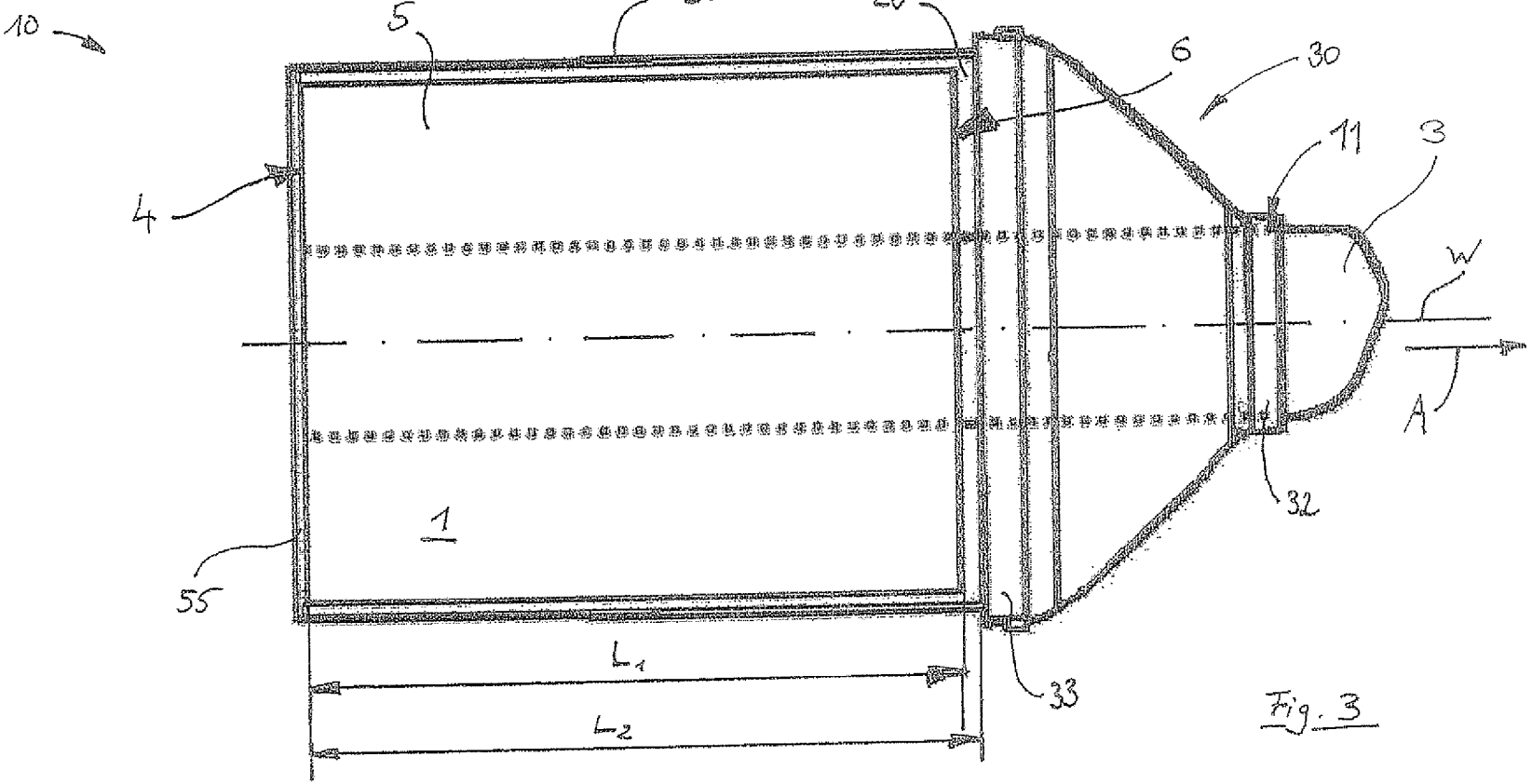
Figure 4:
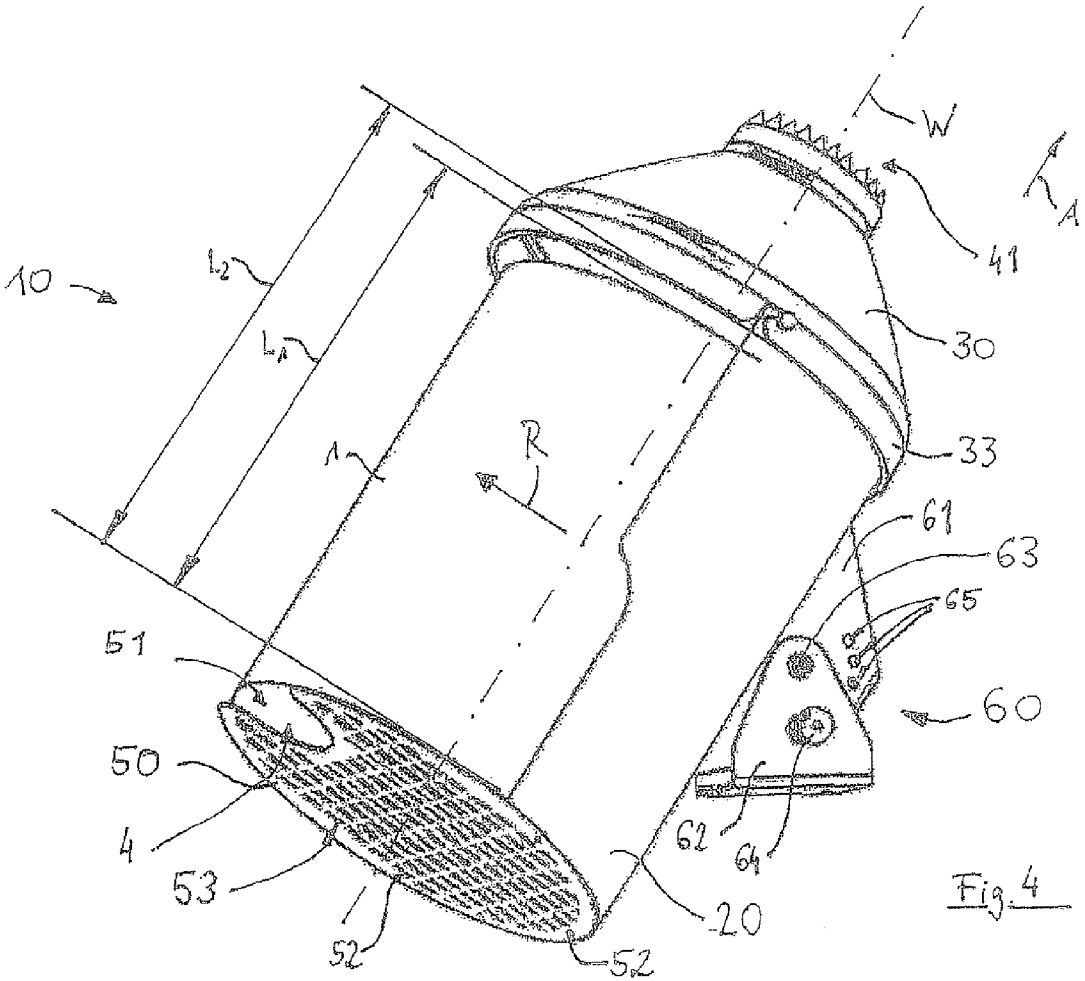
Figure 5:
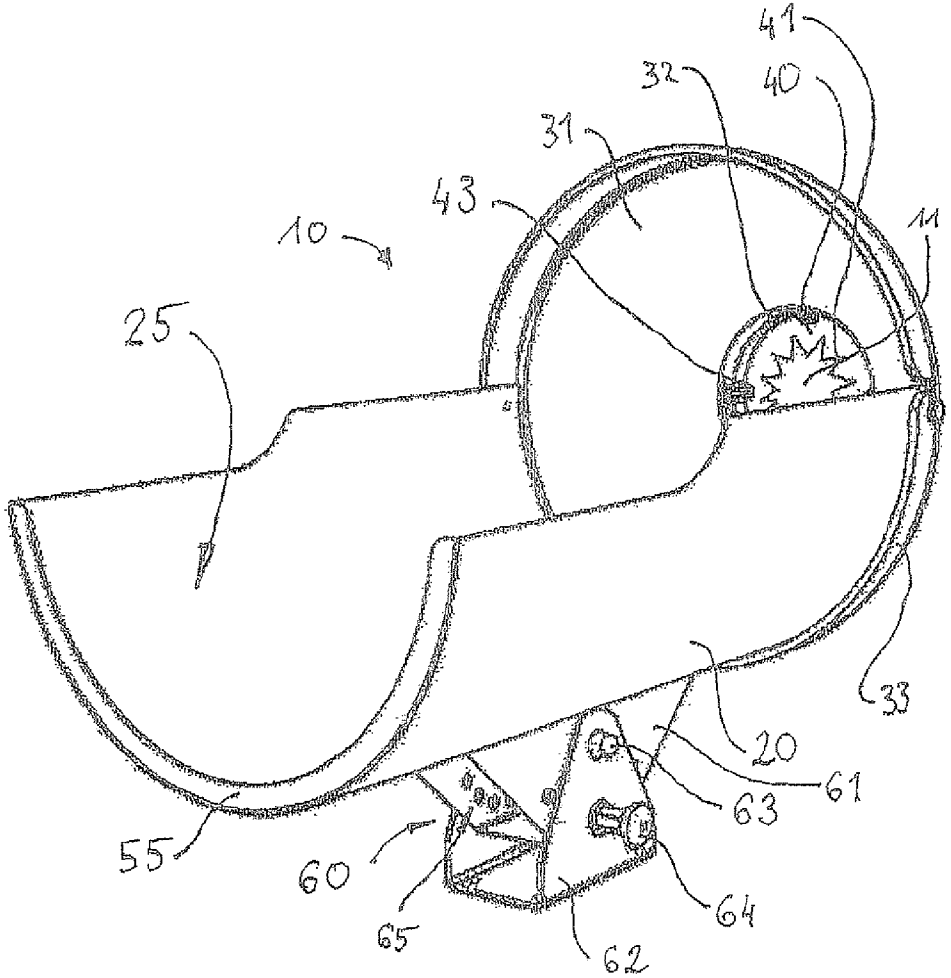
Figure 6:
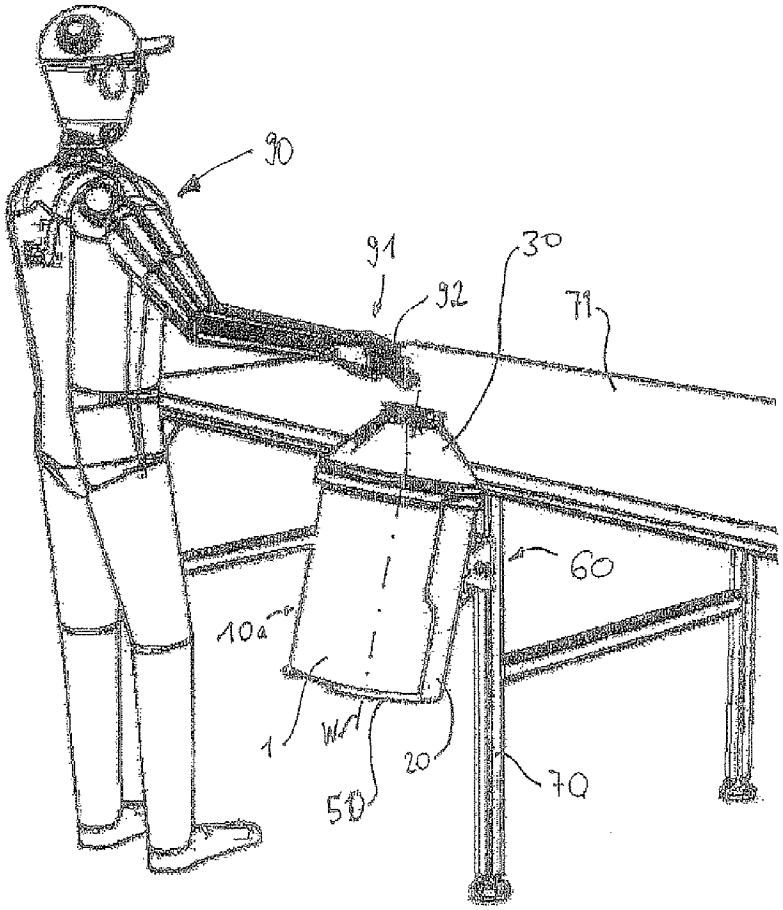
Figure 7:
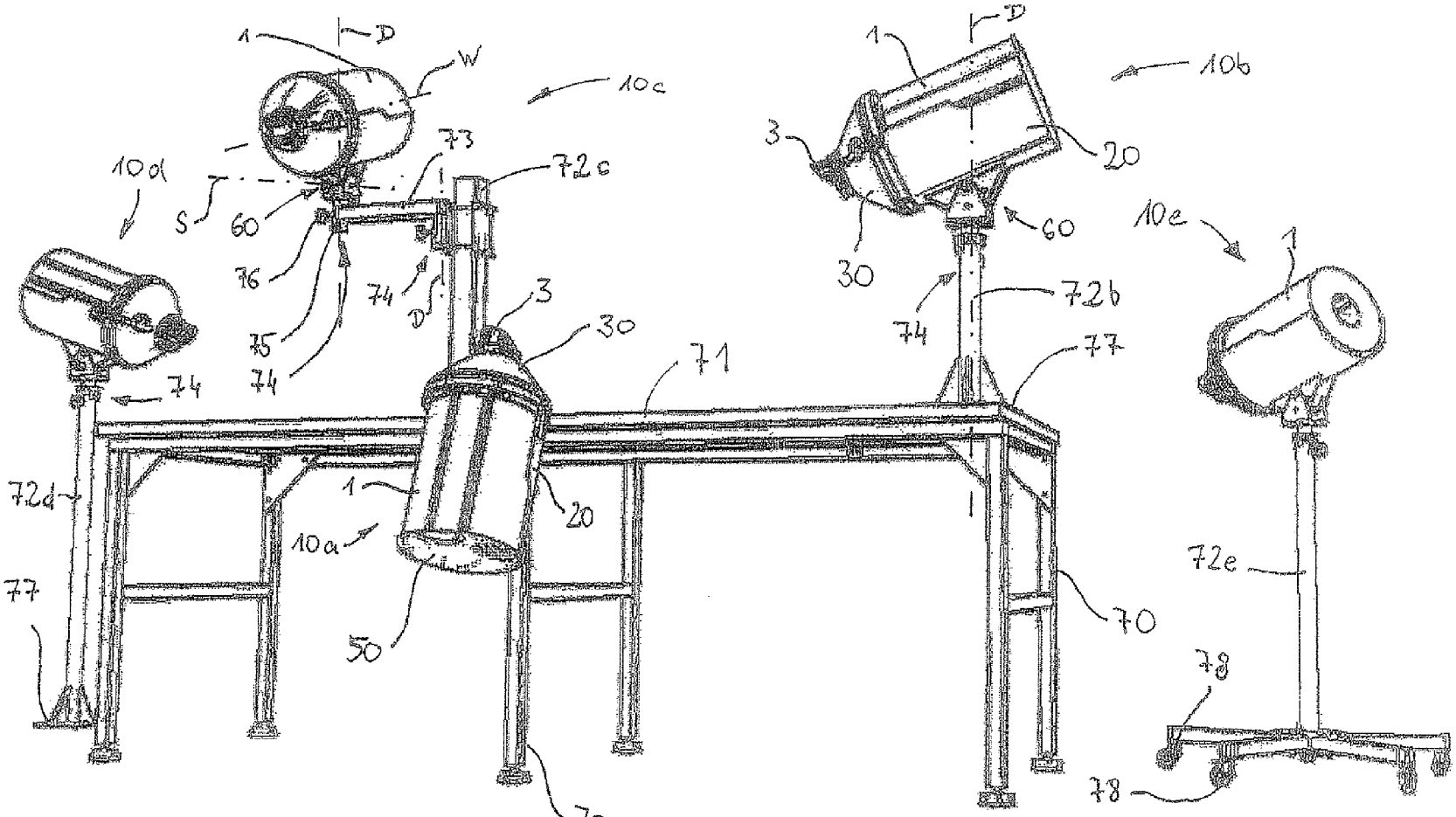

Further features, advantages and characteristics of the invention will become apparent from the following description of preferred embodiments of the invention according to the enclosed figures, which illustrate:

FIG. 1 a perspective view of a device according to the invention for manually creating a packaging material having a partially unwound reel of the web of paper;

FIG. 2 a side view of the device;

FIG. 3 a top view on to the device;

FIG. 4 perspective view of an alternate embodiment of a device according to the invention;

FIG. 5 a third perspective view of a second alternate device according to the invention for creating packaging material;

FIG. 6 a worktable to which a device according to the invention is mounted and an operator;

FIG. 7 a different device according to the invention mounted to a table and/or rack.

In FIGS. 1 through 6, the device according to the invention for manually creating packaging material 3 is illustrated in the form of a packaging material dispenser 10.

The packaging material dispenser 10 comprises as its main component a reception 20 and an axial support attached thereto, which provides an abutment in the axial dispensing direction A for the reel 1, and which is realized as a dispensing funnel 30. Other than the illustrated cone-shaped dispensing funnel 30 also other tapering wall shapes are imaginable for the axial support for providing an axial abutment in the dispensing direction for the reel 1, which, for example, may not be rotationally symmetrical, but only mirror symmetrical, such as an oblique cone.

The dispensing funnel 30 has an exterior wall section 31 tapering in a truncated cone shape from the reception 20 in the direction of the dispensing opening. The opening angle of the interior wall section 31 is about 90°. The wall strength of the dispensing funnel 30 and of the attachment collars 32 and 33 thereof is substantially constant.

The packaging material is initially provided in the form of a reel 1 of a web of paper, which is unwound from the interior side 2 thereof in the axial direction, resulting in a spiral-shaped packaging material 3. The reel lies with the exterior side 5 thereof flat against the interior circumference 25 of the reception 20 which is complementarily shaped with respect to the reel 1, so that the reception 20 positively and force-fittingly encompasses the reel 1. An unwound section 3 of packaging material extends outwardly from the packaging material dispenser 10, on the far side of the dispensing opening of the dispensing funnel 30.

The reception 20 is formed by a half shell. At the front end of the half shell, the reception the 20 has multiple pins 24 engaging a slot 34 of the attachment collar 32, which dispensing funnel 30 encompasses the front end of the reception 20, the pins realizing a snap- and bayonet-connection by means of which the dispensing funnel is held tightly to the reception 20 in any arbitrary orientation and cannot fall down.

At the back end of the reception 20, an end abutment 55 extends radially inwards from the reception 20. When the reel 1 web of paper slides backwards in the axial direction A, it abuts against the end abutment 55 and does therefore not fall out of the reception 20.

The reel 1 of web of paper can be loaded into the reception 20 by the operator at an angle from behind, or in the radial direction R. The loading aperture extends between the dispensing funnel 30 and the end abutment 55. At the outside of the reception 20, opposite from the loading aperture or opposite the reel 1, respectively, the packaging material dispenser 10 has a pivoting device 60.

The pivoting device 60 comprises a flange 61 at the side of the reception and a mounting flange 62, as well as a pivot pin 63 extending through flanges 61 and 62 and defining a pivot axis S. The pivot axis S stands perpendicular with respect to the axial direction A and is usually arranged between the winding axis W of the reel 1 of web of paper and a member to which the flange 62 is attached.

The flange 62 at the carrier structure side has multiple openings or apertures 65 arranged in a circle of constant diameter around the receptacle of the pivot pin 63. Usually, the number of openings 65 is at least 3 and an odd number. One (not visible) opening 65 is arranged in the radial direction R below the pivot pin 63 for allowing horizontal arrangement of the packaging material dispenser 10.

For securing a pivot position of the packaging material dispenser 10, the locating pin 64 is inserted through the flange 62 and a not visible opening of the flange 61 at the reception side.

FIG. 2 shows a side view of a horizontally arranged packaging material dispenser 10 into which no reel of web of paper has been inserted.

The dispensing funnel 30 has a cone-like tapering interior wall section (not shown in FIG. 2), a front attachment collar 32, a back attachment collar 33, and rounded transitions therebetween. At the front attachment collar 32, a blade having an attachment ring 14 is attached by means of two screws 42, the blade having a plurality of teeth 41. By means of the teeth 41, unwound packaging material (not illustrated) can be separated from the reel of web of paper (not illustrated).

The back attachment collar 33 has snap- and bayonet-connection slots 34 engaged by corresponding pins 24 of the reception 20.

The reception 20 is shell-shaped in FIG. 2, and its axis of rotation corresponds to the winding axis W of the (not illustrated) reel of web of paper.

The front or posterior area of the reception 20 has a retaining section 22 extending over more than half of the cylinder circumference of the reception 20. The back or anterior part of the reception 20 has a support section 21 encompassing less than half of the cylinder circumference of the shell-shaped reception 20. Between the support section 21 and the retaining section 22, a continuous transition 23 is arranged. The operator can easily load the packaging material dispenser 10 with the reel 1 by holding the inside the reel 1 with both hands and then inserting it into the loading aperture of the reception 20. While loading the reception 20, the support section 21 provides a resistance only then when the reel 1 is completely inserted. As soon as the reel engages the continuous transition 23, the elasticity of the reception 20 can be utilized in order to slightly bend the retaining section 22 of the reception 20 open to easily insert the reel of the web of paper. When the reel of web of paper is inserted, the retaining section 22 of the reception 20 also lies abutting against the outer circumference 5 of the reel 1 (cf.: FIG. 1) in order to avoid that the reel 1 can slide or roll out of the reception 20 in the radial direction. These circumferential ends of the retaining section 22 and the support section 21 each are arranged diametrically opposite one another.

FIG. 3 shows from above a horizontally aligned packaging material dispenser 10 having a reel 1 of web of paper inserted therein.

The reel 1 of web of paper in FIG. 3 lies with the outer circumference 5 thereof abutting against the slightly larger interior circumference 25 of the reception 20. The inside of the reel 1 of web of paper formed by the innermost windings thereof is indicated by dotted lines. By drawing the inner end of the reel 1 web of paper, packaging material 3 is provided which exits from the dispensing opening 11 in shape of a spiral.

The lower side 4 and the front side 6 of the reel 1 of a web of paper each extend in one plane in FIG. 4. In particular the front side 6 can abut against an interior wall section of the dispensing funnel 30 (not illustrated) and thus be deformed towards the dispensing opening 11. The front side 6 is thus deformed correspondingly to the shape of the interior wall section both when the packaging material 3 is drawn by drawing along windings adjacent to the innermost winding as well as when the dispenser 10 is arranged with the dispensing opening 10 facing vertically downwards or downwards at an angle.

The length L1 of the reel 1 in the axial direction A is here about 3 cm smaller than length L2 of the loading aperture of the reception 20 between the end abutment 55 in the back attachment collar 33.

FIG. 4 illustrates the packaging material dispenser 10 loaded with a reel 1 of the web of paper and having an end abutment in the shape of a substantially fully circumferential ledge 50.

The packaging material dispenser 10 can substantially only be loaded in the radial direction R. The aperture for loading the packaging material dispenser 10 has the length L2 in the axial direction A. The reel 1 has the length L1 in the axial direction A. The longitudinal dimension L2 of the loading aperture is only slightly larger than the longitudinal dimension L1 of the reel 1 so that an operator can grip the reel 1 of web of paper at the lower side 4 and the front side thereof and fit it into the reception 20, this action is in particular being simplified by a convex handling aperture 51 in the ledge 50. Since the longitudinal dimension L2 is no more than about 10% larger than the longitudinal dimension L1 the reel 1, a reel 1 of the web of paper which threatens to tip laterally out of the packaging material dispenser 10 would about against a resistance in form of the back attachment collar 33 of the dispensing funnel 30 such that the reel 1 is stopped from falling out of the packaging material dispenser 10.

Unlike the packaging material dispensers shown in FIG. 1 and FIG. 2, the one shown in FIG. 4 is arranged with the dispensing opening facing upwards at angle, wherein the flange 62 of the pivoting device 60 is nevertheless arranged horizontally. Dependent upon the member to which the flange 62 is to be attached, it can take pivot positions defined by the locating pin 64 and an aperture 65.

Reel 1 of web of paper is particularly held in position by ledge 50. The ledge 50 is substantially shaped fully circular and thus supports almost the entire lower side 4 of the reel 1 which prevents the inner windings of the reel 1 to slide out of the packaging material dispenser 10 due to gravity.

The ledge 50 comprises a plurality of apertures 53 shaped as squares and arranged in a grid like manner so that the ledge is shaped lattice-like. Generally, the ledge openings 53 can also have other shapes and do not have to be arranged in a grid. The ledge 50 is attached to the reception 20 using multiple screws 52.

The packaging material dispenser 10 has a plurality of teeth 41 arranged circularly around the dispensing opening 11 of the dispensing funnel 30. In FIG. 4, the teeth 41 are arranged substantially in the axial direction A, so that the operator cannot hurt himself when grasping through the dispensing opening and particularly when drawing the packaging material outwardly in the axial direction A.

FIG. 5 again illustrates a horizontally arranged packaging material dispenser 10. The funnel shaped interior wall section 31 has no obstacles at its inside against which the (not illustrated) paper web can come up against during unwinding. The front attachment collar 32 of the dispensing funnel 30 has a plurality of protrusions 43 for screws (not illustrated) for attaching an attachment ring 40 having teeth 41 to the dispensing opening 11. Teeth 41 are substantially radially arranged in FIG. 5 so that the packaging material can be ripped by the teeth 41 even when only little effort is applied. Both attachment collars 32, 33 are substantially cylinder-sleeve-shaped.

FIG. 6 shows an operator 90 grasping with his hand 91 in the direction of the dispensing opening of the packaging material dispenser 10*a*. The packaging material dispenser 10*a* is attached by means of the attachment flange of a pivoting device 60 to a leg 70 of the table. The dispensing opening of the packaging material dispenser is substantially oriented vertically upwards. Ledge 50 of the packaging material dispenser 10*a* prevents the reel 1 of web of paper material to fall down, out of the dispenser 10*a*, or from involuntarily unwinding downwardly.

The opening aperture of the packaging material dispenser 10*a* is dimensioned sufficiently large for the operator 90 to grasp therethrough using several fingers 92 in order to unwind packaging material 3 from reel 1.

FIG. 7 illustrates different possibilities of how different packaging material dispensers 10 can be attached to a table leg 70, a table top 71, or a rack 72. The packaging material dispenser 10*a* is substantially attached to the table leg 70 as illustrated in FIG. 6.

The packaging material dispenser 10*b* is attached to the rack 72*b* by means of a pivoting device 60 and a rotation device 74, which rack 72*b* is cylinder sleeve shaped and thus at the same time forms a part of the rotation device 74. The packaging material dispenser 10*b* is attached onto the table top 71 by means of the attachment plate 77. The packaging material dispenser 10*b* is oriented with its dispensing opening sloping leftwards and downwards in the direction of the tabletop 71.

The packaging material dispenser 10*c* is attached to the rectangular rack 72*c* via cantilever arm 73. The cantilever arm 73 has one rotating device 74 each at either end thereof. The first rotating device 74 is arranged close to the rack 72*c* and the second one immediately below the pivoting device 60 of the packaging material dispenser 10*c*, so that the axis of rotation D of the second rotating device 74 intersects the reception 20 of the packaging material dispenser 10*c* and a reel 1 of web of paper arranged therein. The packaging material dispenser 10*d* is arranged on a rack 72*d* by means of an attachment plate 77 which is attached immediately to the floor and which is otherwise a similar to the rack of the packaging material dispenser 10*b*.

The rack 72*e* of the packaging material dispenser 10*e* has five rolling wheels 78. At least one, preferably two, of the wheels 78 can be fixed so that the rack 72*e* of the packaging material dispenser 10*e* is prevented from inadvertently rolling around.

The features disclosed in the above description, the figures and the claims can each be of importance by themselves as well as in any combination for realizing the invention in the different embodiments thereof.

REFERENCE NUMERALS

1 reel of web of fiber material
2 inside of reel
3 unwound packaging material
4 lower side of reel
5 exterior circumference of reel
6 reel front side
10 packaging material dispenser
11 dispensing opening
20 reception
21 support section
22 retaining section
23 transition
24 pin
25 interior circumference of reception
30 dispensing funnel
31 interior wall section
32 front attachment collar
33 back attachment collar
34 slot
40 attachment ring
41 teeth
42 screw
43 protrusion
50 ledge
51 handling aperture
52 screw
53 apertures
55 end abutment
60 pivoting device
61 reception side flange
62 mounting flange
63 pivot pin
64 positioning pin
65 aperture
70 table leg
71 table top
72 rack

73 cantilever arm
74 rotation device
75 pin receptacle
76 fixation pin
77 mounting plate
78 wheel
90 operator
91 hand
92 finger
A axial direction
D axis of rotation
L1 length of reel
L2 length of loading aperture
R radial direction
S pivot axis
W winding axis

The invention claimed is:

1. A device for manually forming spiral-shaped packaging material, comprising:

a reception for at least partially encompassing a wound reel of a web of fiber material defining an axial direction and forming an interior side from which the web of fiber material is drawn for shaping the packaging material, the reception having a constant diameter and having a first at least partial circumference configured to receive the reel of the web fiber material, and an axial support connected to the reception, the axial support supporting an axial front side of the reel of the web of fiber material, the axial support having a dispensing opening formed therein for dispensing the packaging material in the axial direction, and comprising an interior wall section facing the axial front side, the interior wall section being formed as a dispensing funnel having a first end adjacent the reception and a second end adjacent the dispensing opening where the first end of the interior wall section has a second circumference and where the first end connects to a front end of the reception, the interior wall section tapering from the first end towards the second end.

2. The device according to claim 1, wherein the interior wall section has an opening angle, the opening angle of the interior wall section is in the range of between approximately 30° and 150°.

3. The device according to claim 1, wherein the reception is attached to the axial support in a releasable manner.

4. The device according to claim 1, wherein the axial support comprises at least one attachment collar that connects to the interior wall section in the axial direction.

5. The device according to claim 4, wherein the reception is partially cylindrical and the at least one attachment collar encompasses the outside of the partially cylindrical reception.

6. The device according to claim 4, wherein the at least one attachment collar comprises a slot cooperating with a moveable pin.

7. The device according to claim 4, wherein the at least one attachment collar is configured for attaching a blade.

8. The device according to claim 1, wherein the dispensing opening defines an interior circumference and a blade is arranged at the interior circumference of the dispensing opening.

9. The device according to claim 8, wherein the blade has multiple teeth extending at least partially in one of radial direction and the axial direction.

10. The device according to claim 8, wherein the blade has an attachment ring releasably attached to the axial support.

11. The device according to claim 1, wherein the dispensing opening has an interior diameter, the interior diameter of the dispensing opening is in the range of between 2.5 cm and 30 cm.

12. The device according to claim 1, wherein the reception is shaped substantially semi-cylindrical and comprises at least one support section and at least one retaining section, the retaining section extending over at least 180°, and the support section extending over at most 180°, wherein the support section is arranged in the direction of the dispensing material behind the retaining section.

13. The device according to claim 12, wherein the at least one retaining section is longer than the at least one support section in the axial direction.

14. The device according to claim 1, wherein the reception has an end abutment opposite to the axial support and extending radially inwards, the end abutment being formed as a ledge and comprising at least one of a convex handling aperture and lattice-like openings.

15. The device according to claim 1, wherein the reception comprises a flange extending radially from the reception and through which a pivot pin at least partially extends in a direction perpendicular to the axial direction, the pivot pin defining a pivot axis around which the reception can be pivoted, wherein the distance from a winding axis of the reel to the pivot pin is substantially equal to the distance of the winding axis to the pivot axis.

16. The device according to claim 15, wherein the pivot pin extends through at least part of a mounting flange and a locating pin extends at least partially through the flange and through the mounting flange for defining a pivot position, the locating pin extending in parallel with the pivot axis.

17. The device according to claim 16, wherein one of the flange and the mounting flange comprise a plurality of locating apertures corresponding to the locating pin for defining a pivot position.

18. The device according to claim 1, wherein the reception is mounted to a carrier structure.

19. The device according to claim 15, wherein the carrier structure comprises a rotating device allowing for a rotary movement of the reception around an axis of rotation which is not the winding axis and which is arranged perpendicular with respect to the pivot axis and intersects the reception.

* * * * *